US005642099A

United States Patent [19]

Nagashima

[11] Patent Number: 5,642,099

[45] Date of Patent: Jun. 24, 1997

[54] LIGHT SCATTERING TYPE SMOKE DETECTOR

[75] Inventor: Tetsuya Nagashima, Sagamihara, Japan

[73] Assignee: Hochiki Kabushiki Kaisha, Tokyo, Japan

[21] Appl. No.: 499,724

[22] Filed: Jul. 7, 1995

Related U.S. Application Data

[63] Continuation of Ser. No. 112,687, Aug. 26, 1993, abandoned.

[30] Foreign Application Priority Data

Aug. 28, 1992 [JP] Japan ..... 4-229501
Aug. 28, 1992 [JP] Japan ..... 4-229502

[51] Int. Cl.[6] ..... G08B 17/10

[52] U.S. Cl. ..... 340/630; 340/628; 340/629; 250/574; 356/438

[58] Field of Search ..... 340/628, 629, 340/630; 250/574, 485.1, 338.3; 356/43, 51, 438

[56] References Cited

U.S. PATENT DOCUMENTS

| | | | |
|---|---|---|---|
| 3,681,603 | 8/1972 | Scheidweiler et al. | 340/630 X |
| 4,672,217 | 6/1987 | Dobrzanski | 340/630 |
| 4,758,733 | 7/1988 | Mochizuki | 340/630 X |
| 4,851,819 | 7/1989 | Kawai et al. | 340/630 |
| 4,857,895 | 8/1989 | Kaprelian | 340/630 |
| 4,897,634 | 1/1990 | Sawa et al. | 340/630 |
| 5,021,677 | 6/1991 | Igarashi et al. | 340/630 X |
| 5,138,302 | 8/1992 | Nagaoka et al. | 340/630 |

*Primary Examiner*—Jeffery Hofsass
*Assistant Examiner*—Edward Lefkowitz
*Attorney, Agent, or Firm*—Lackenbach Siegel Marzullo Aronson & Greenspan, PC

[57] ABSTRACT

A light scattering type smoke detector arranged such that even if the range in which light from an LED is emitted has a dispersion, a labyrinth member 90 in the light emitting range has no edge or only a predetermined labyrinth member exist therein. The labyrinth member 90 is preferably formed by a single plate larger than the other labyrinth members 9. The edges of the labyrinth members 9 are preferably formed to a curved surface or chamfered, and the dispersion of the 0 point of a detection output is reduced and the level of the 0 point of the detection signal is lowered to thereby accurately detect light scattered by smoke.

1 Claim, 7 Drawing Sheets

LIGHT SCATTERING TYPE SMOKE DETECTOR

This application is a continuation of application Ser. No. 08/112,687, filed Aug. 26, 1993 now abandoned.

BACKGROUND OF THE INVENTION

1. Field of the Invention

The present invention relates to a light scattering type smoke detector for detecting smoke by detecting a light scattered by smoke. More specifically, the present invention relates to a light scattering type smoke detector having a labyrinth member structure in which the capability for detecting light scattered by the smoke is enhanced by preventing the dispersion at the 0 point level of a detection output for each detector or by setting the 0 point to a low level.

2. Description of the Related Art

In general, as shown in FIGS. 5–7, this kind of the light scattering type smoke detector is provided with labyrinth members 9 for forming a smoke detecting chamber at the central portion of the detector so as to enable the easy inflow of smoke from the outside and the shut off light therefrom. Further, a light emitting device 12 and a light receiving device 13 are disposed so that the optical axes thereof intersect in the smoke detecting chamber formed by the labyrinth members 9. When smoke flows into the smoke detecting chamber, a light emitted from the light emitting device 12 is irregularly reflected by the particles of the smoke and the smoke can be detected by detecting a light scattered by the smoke.

This conventional smoke detector is arranged as described below. A smoke detecting unit main body 2 is formed to a substantially cylindrical shape as shown in FIG. 6. Also, as illustrated in FIG. 5, the smoke-detecting unit main body 2 is fitted in a recessed portion 1*a* formed at a lower central portion of a casing 1 and fixed to brackets 4 disposed at the rear of the casing 1 by screws 3. Note, the smoke detector shown in FIG. 6 is vertically upset with respect to the state in which it is actually mounted. The upper wall 8 is formed so that a plurality of labyrinth members 9 stand thereon. Then, the smoke detecting chamber is formed in the region surrounded by the labyrinth members. Each of the labyrinth members 9 has a horizontal cross section substantially formed to a ridge-roofshape or L-shape so that smoke can easily flow thereinto from the outside and light from the outside is shut off. Smoke inflow ports formed between the labyrinth members are surrounded by an insect control net 5 to prevent insects entering the smoke detecting chamber from scattering a light. A printed circuit board 30 with detector circuitry packaged thereon is placed on a upper wall 8. Upper side of the printed circuit board 30 is covered by an upper seal cover 20. An outer cover member 7 is fitted to the lower side of the upper wall 8 through a lower wall 6 interposed therebetween. The outer cover member 7 has a plurality of openings 7*a* for allowing smoke to enter the smoke-detecting unit 2.

The upper wall 8 is also provided with recessed portions 10, 11 and a shade plate 14. The light emitting device 12 and light receiving device 13 are accommodated by the recessed portions 10, 11, respectively so that the respective optical axes thereof intersect at the center of the smoke detecting chamber formed by the labyrinth members 9. Further, the shade plate 14 is standingly formed to prevent a light emitted from the light emitting device 12 from directly reaching the light receiving device 13. Further, an opening is formed to each of the recessed portions 10, 11 so that the light from the light emitting device 12 is not directly received by the light receiving device 13.

In the detector arranged as described above, a detection output from the light receiving device 13 is set to a 0 point level, namely the state of no smoke. On the other hand, when smoke flows into the smoke detecting chamber, a scattered light is produced by the particles of the smoke and the light is detected by the light receiving device 13. More specifically, an amount of light in the light receiving device 13 is increased with respect to the aforesaid 0 point level, whereby it is detected that the smoke flows into the smoke detecting chamber and thus the smoke is detected.

Incidentally, in the detector arranged as described above, the light from the light emitting device 12 must not be incident upon the light receiving device 13 as far as possible when there is no smoke to improve the sensibility of the detector. For this purpose, this detector is designed to introduce the light from the light emitting device 12 to the outside of the smoke detecting chamber through the labyrinth members 9. Nevertheless, the light is partly incident upon the light receiving device 13 after it has been reflected by the labyrinth members a plurality of times. Therefore, since this light acts as a noise light, a detection signal is produced by the light receiving device 13 even if there is no smoke in the smoke detecting chamber. That is, a so-called 0 point level exists in the detector due to a detection signal produced by the light receiving device 13 under the influence of the noise light. Therefore, in the light scattering type smoke detector, the 0 point level is set first and smoke is detected by using the 0 point level as a reference.

Therefore, the structure inside the detector must be arranged so as to set the 0 point level as low as possible by reducing a noise component to improve the sensitivity of the detector. That is, the interior of the detector is preferably formed to have such a structure that the light from the light emitting device 12 is not reflected in the direction of the light receiving device 13. For this purpose, the labyrinth members of the conventional detector are formed so that the edges thereof have a radius of curvature as small as possible, i.e., r=0 is achieved. Note, the labyrinth members are molded of plastics by using, for example, a metal mold.

Although the aforesaid detector is arranged so that the light from the light emitting device 12 is not directly received by the light receiving device 13, however, the labyrinth members 9 are disposed around the light receiving device 13 and thus the reflection of light therefrom cannot be avoided. Further, although the edges of the labyrinth members 9 are also formed to have the radius of curvature as small as possible as described above, the light from the light emitting device 12 is also irregularly reflected by the edges of the labyrinth members 9 as shown by the arrows in FIG. 7. Therefore, the 0 point level of the detection output is increased by the irregular reflection.

On the other hand, although the light emitting device 12 is usually composed of a near infrared LED or the like, it has a dispersion in the direction of a light emitting optical axis due to manufacture assembly and the like. Further, although the LED is fixed in the recessed portion 10 and the light emitting range thereof is restricted by the opening of the recessed portion, a dispersion is caused to the light emitting range due to the dimensional errors of the LED and the recessed portion 10 and the assembling error of the LED. More specifically, when the LED has a light emitting range of 10–20°, a dispersion of +/–3–5° is caused.

As described above, in the conventional detector, the number of the edges of the labyrinth members 9 located in the light emitting range and the positions thereof are different to each detector due to the dispersion of the light emitting range of the LED. Therefore, a problem arises in that a large dispersion at the 0 point level of a detection output is caused to each detector.

Further, in the above conventional detector, since the labyrinth members 9 are made so that the edges thereof satisfy r=0, the edge portion of a metal mold is arranged to achieve r=0. Consequently, the curvature of the edge is different due to the flow of plastics and thus a dispersion of, for example, 0.03<r<0.08 is caused as shown in FIG. 8. Further, the edges of the labyrinth members 9 may be chipped off when they are released from the metal mold. Therefore, a problem arises in that a large dispersion at the 0 point level of the detection output is caused to each detector due to the dispersion of the radius of curvature of the edges and the chipping-off thereof. Further, a problem also arises in that defective products are made and yield deteriorates depending upon said manufacturing process.

OBJECTS AND SUMMARY OF THE INVENTION

In view of the above, an object of the present invention is to provide a light scattering type smoke detector having a high sensitivity capable of accurately detecting a light scattered by smoke.

Second, an object of the present invention is to provide a light scattering type smoke detector capable of setting the 0 point of an output detecting a light scattered by smoke to a low level.

Third, an object of the present invention is to provide a light scattering type smoke detector capable of preventing the dispersion of the 0 level of a detection output for each detector.

To achieve the above objects, according to the present invention, there is provided a light scattering type smoke detector enabling the easy inflow of smoke from the outside as well as shutting off light from the outside and having labyrinth members for forming a smoke detecting chamber at the central portion thereof and a light emitting device and a light receiving device disposed so that the respective optical axes thereof intersect in the smoke detecting chamber formed by the labyrinth members, wherein the labyrinth members are formed so that the edges thereof do not exist at the position to which a light may be emitted from the light emitting device, by taking the dispersion of the light emitting range of the light emitting device itself and the dispersion of the light emitting range caused by assembling the light emitting device into consideration.

According to the present invention, with the above arrangement, since the labyrinth member is formed so that the edge thereof does not exist at the position which may be the light emitting region of the light emitting device, by taking the dispersion of the light emitting region of the light emitting device itself and the dispersion of the light emitting region caused by assembling the light emitting device into consideration, the dispersion at the 0 point level of the detection output for each detector can be prevented. Further, since light from the light emitting device is prevented from being irregularly reflected by the edge of the labyrinth member, the 0 point of the detection output of light scattered by smoke can be set to a low level.

According to the present invention, since the labyrinth members are formed so that the edge thereof exist at the position to which a light is always emitted from the light emitting device and the edges other than the edge do not exist at the position excluding the light emitting range to which a light may be emitted from the light emitting device, by taking the dispersion of the light emitting range of the light emitting device itself and the dispersion of the light emitting range caused by assembling the light emitting device into consideration, the dispersion at the 0 point level of the detection output for each detector can be prevented. Further, since a light from the light emitting device is prevented from being irregularly reflected by the edges other then the edge formed at the position which serves as the light emitting range of the light emitting device without fail, the 0 point of the detection output of a light scattered by smoke can be set to a low level.

Further, according to the present invention, in order to achieve the above objects, there is provided a light scattering type smoke detector having members forming a smoke detecting chamber at the central portion thereof and a light emitting device and a light receiving device disposed so that the respective optical axes thereof intersect in the smoke detecting chamber formed by labyrinth members, wherein the edges of the labyrinth members are formed to a predetermined radius of curvature.

According to the present invention, there is also provided a light scattering type smoke detector enabling the easy inflow of smoke from the outside as well as shutting off light from the outside and having labyrinth members for forming a smoke detecting chamber at the central portion thereof and a light emitting device and a light receiving device disposed so that the respective optical axes thereof intersect in the smoke detecting chamber formed by the labyrinth members, wherein the edges of the labyrinth members are chamfered by a predetermined dimension.

According to these inventions, since the edges of the labyrinth members are preformed to the predetermined curvature or chamfered to a predetermined dimension, when a plastic molding or the like is performed by using a metal mold whose edge portion is formed to the predetermined curvature or chamfered to a predetermined dimension, the edges of the labyrinth members can be formed to an accurate shape. Therefore, since the edges of the labyrinth members in each detector have the shape, the dispersion at the 0 point level of a detection output for the each detector can be prevented.

DESCRIPTION OF THE PREFERRED EMBODIMENTS OF THE INVENTION

Figure 1:
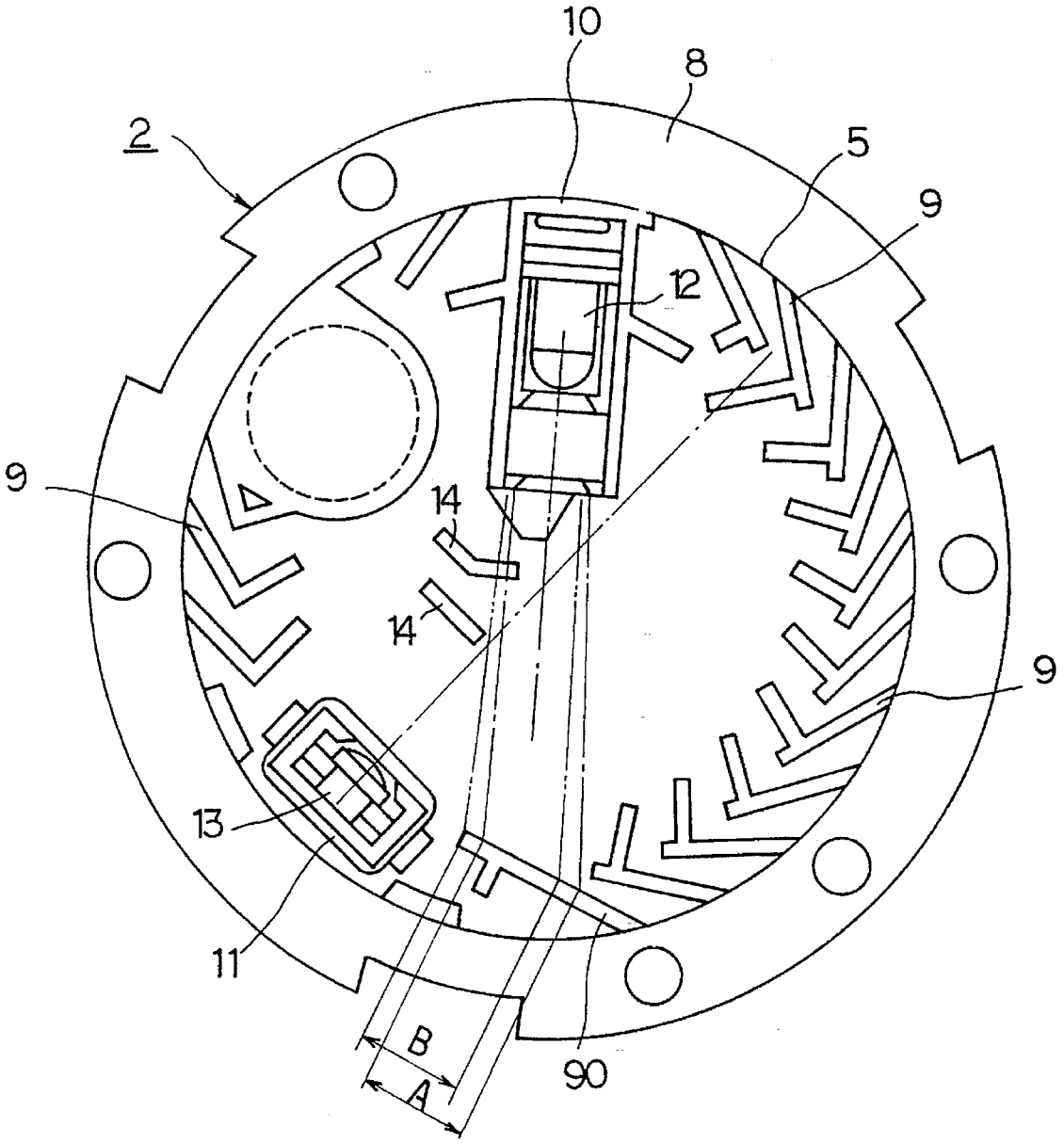
FIG. 1 is a plan view showing the arrangement of a first embodiment of a light scattering type smoke detector according to the present invention.

Embodiments of the present invention will be described below with reference to the drawings. FIG. 1 is a plan view showing the arrangement of a first embodiment of a light scattering type smoke detector according to the present invention. Note, the basic arrangement of this detector is the same as the conventional smoke detector shown in FIGS. 5, 6.

Figure 5:
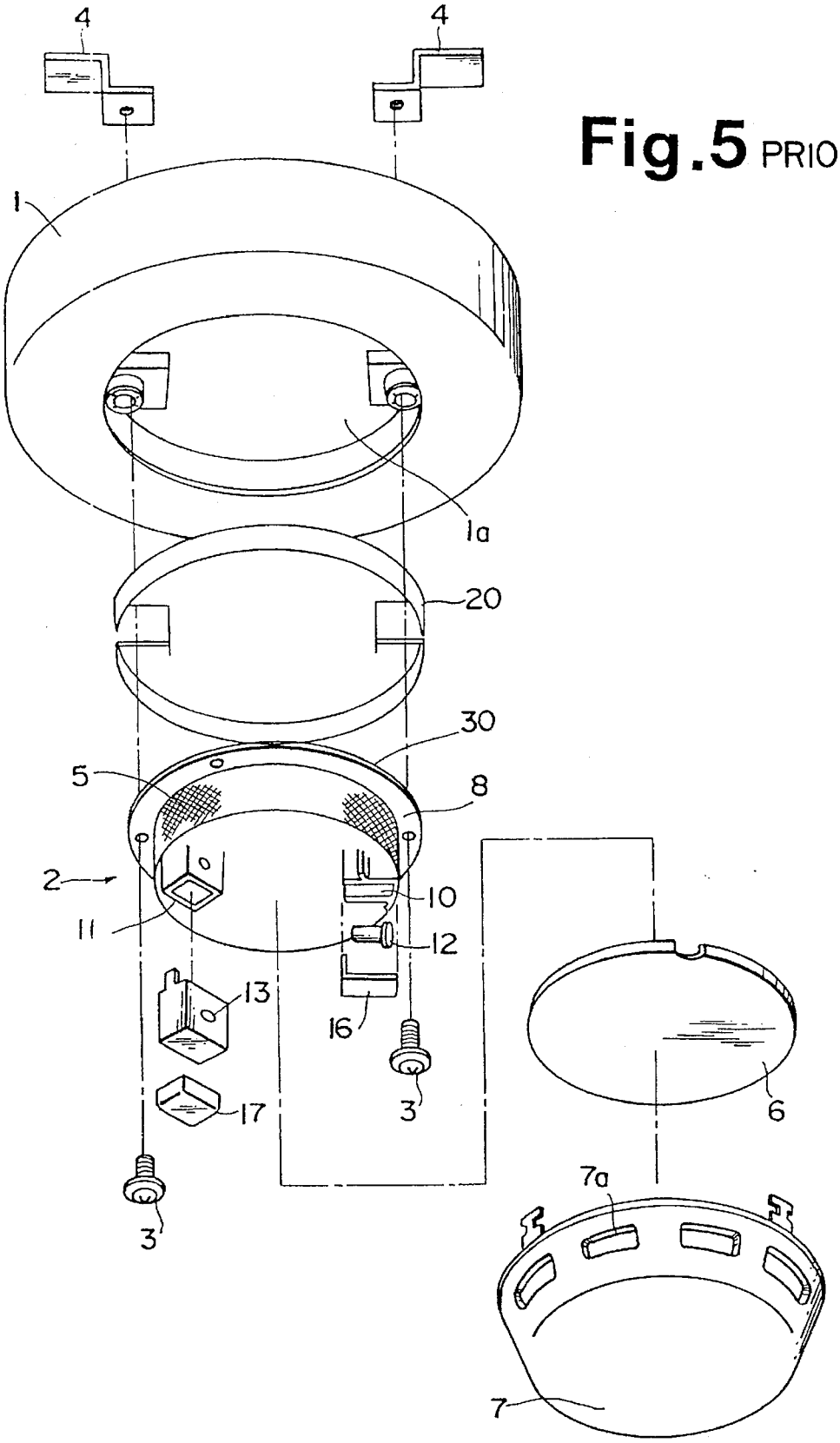
Fig.5 PRIOR ART
FIG. 5 is an exploded perspective view showing the arrangement of a conventional light scattering type smoke detector.
Figure 6:
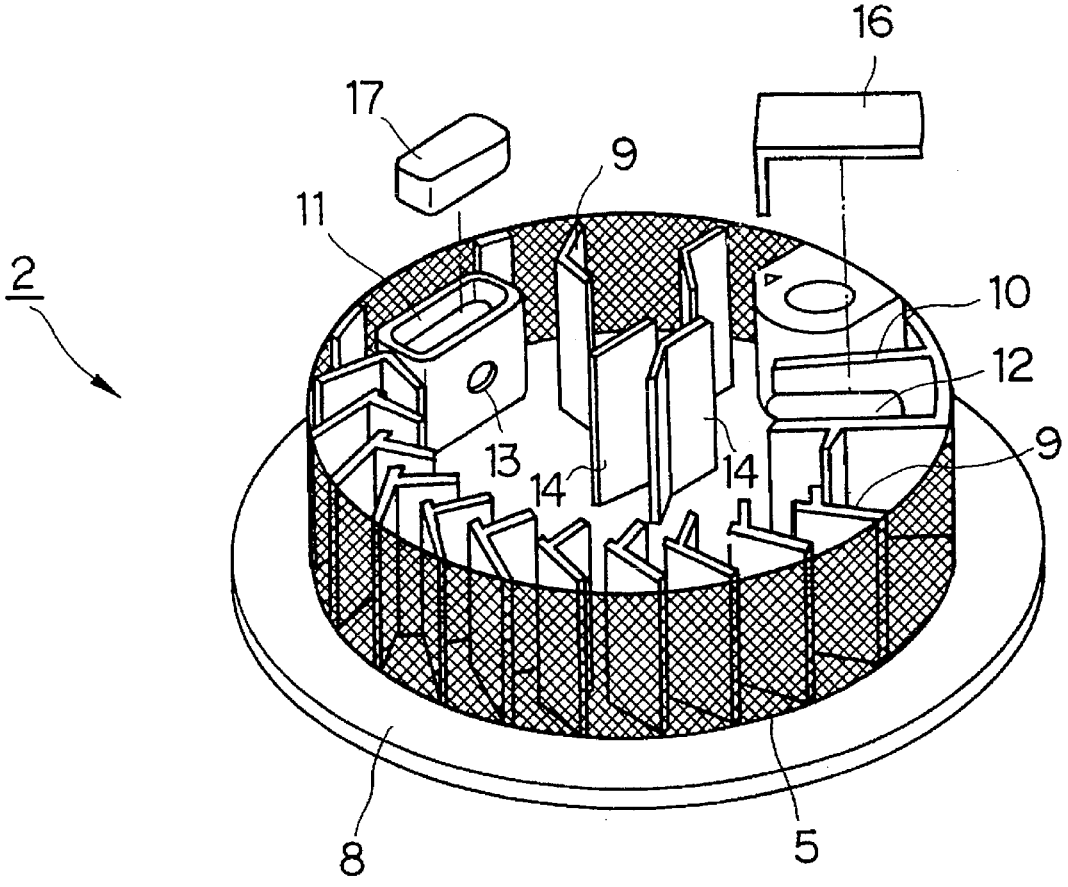
Fig.6 PRIOR ART
FIG. 6 is a perspective view showing the arrangement of a conventional light scattering type smoke detector.
Figure 7:
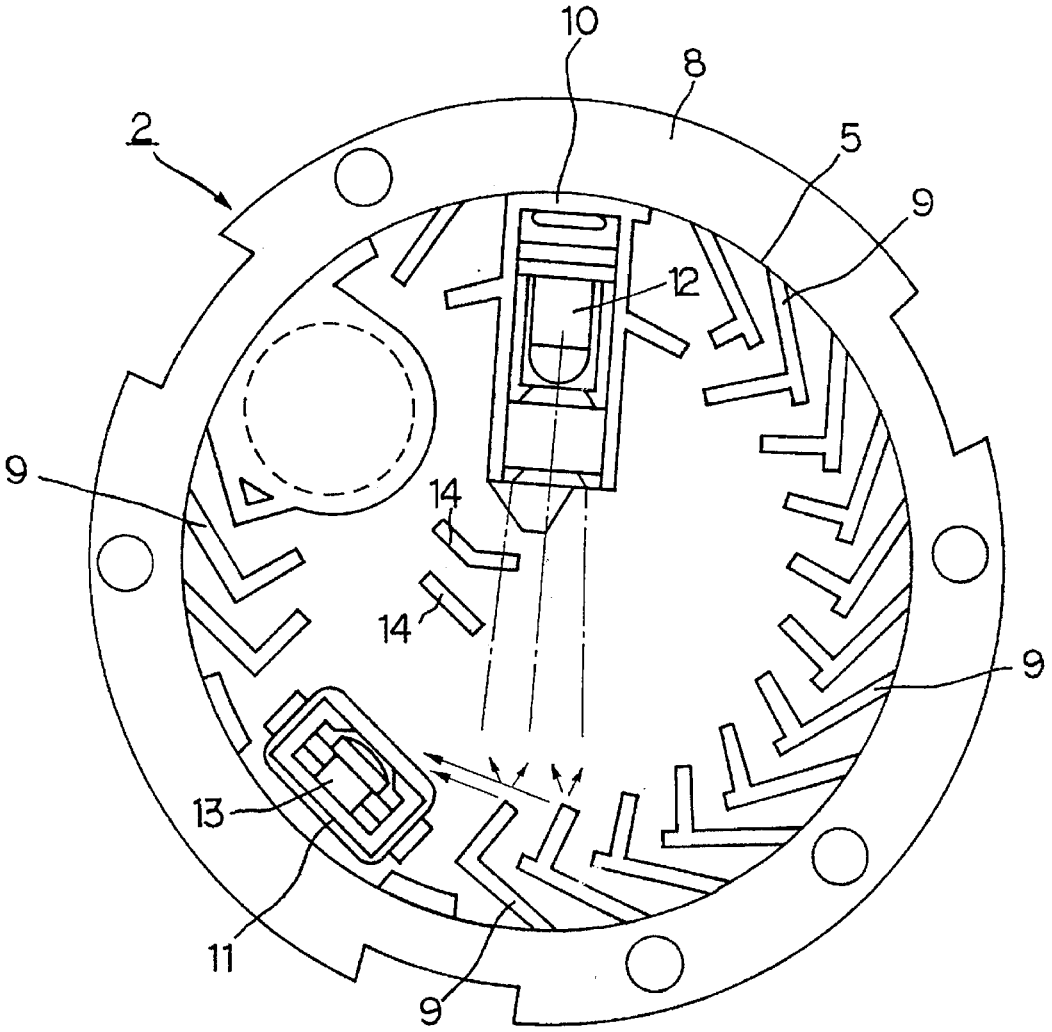
Fig.7 PRIOR ART
FIG. 7 is a plan view showing the arrangement of the light scattering type smoke detector shown in FIG. 6.
Figure 8:
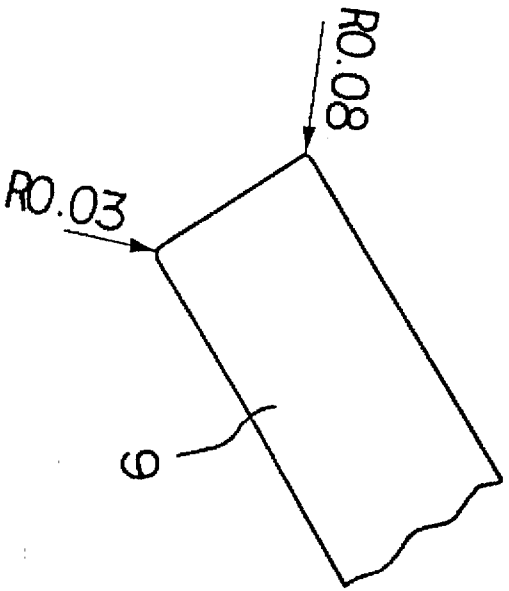
Fig.8 PRIOR ART
FIG. 8 is a diagram explaining the edge of a conventional labyrinth member.

In FIG. 1, a smoke detecting unit main body 2 is formed to a substantially cylindrical shape shown in FIG. 5, 6 and with an upper wall 8 attached to the ceiling through a case 1 thereof. Note, the smoke detector shown in FIG. 1 is vertically upset with respect to the state in which it is actually mounted. The upper wall 8 is formed so that a plurality of labyrinth members 9 stand thereon. Then, the smoke detecting chamber is formed in the region surrounded by the labyrinth members 9. Each of the labyrinth members 9 has a horizontal cross section substantially formed to a ridge-roofshape or L-shape so that smoke can easily flow thereinto from the outside and light is shut off therefrom. Smoke inflow ports formed between the labyrinth members are surrounded by an insect control net 5 to prevent insects entering the smoke detecting chamber from scattering light.

The upper wall 8 also has recessed portions 10, 11 formed thereto to accommodate a light emitting device 12 and a light receiving device 13 therein, respectively so that the respective optical axes of the light emitting device 12 and light receiving device 13 intersect at the center of the smoke detecting chamber formed by the labyrinth members 9. Further, the upper wall 8 has a shade plate 14 standingly formed thereon to prevent light emitted from the light emitting device 12 from directly reaching the light receiving device 13. Further, an opening is formed in each of the recessed portions 10, 11 so that the light from the light emitting device 12 is not directly received by the light receiving device 13. The recessed portions 10, 11 are covered with covers 16, 17, respectively and the smoke detecting chamber is closed by sealing the interior thereof by a lower wall 6.

As described above, the light emitting device 12 is usually composed of a near infrared LED or the like. The LED has an light emitting range of 10–20°. However, a dispersion of +/−3–5° is caused to the light emitting range by the dimensional errors of the LED 12 and the recessed portion 10 and the assembling error of the LED. Consequently, a dispersion is caused in the light emitting range of the light emitting device 12 between a light emitting range A shown by dot-dash lines and a light emitting range B shown by two-dot-and-dash lines B, as shown in FIG. 1. Note, a maximum angle including both ranges A and B is 25° (=20+5).

Thus, as shown in FIG. 1, in this embodiment, a labyrinth member 90 disposed in the light emitting ranges A and B is formed so as to be not provided with an edge by which an irregular reflection is caused. Here, the labyrinth member 90 is composed of a single plate larger than other labyrinth members 9. Therefore, the edge of the labyrinth member 90 does not exist at the position to which light may be emitted from the light emitting device 12. Therefore, there is no difference in the number of the edges of the labyrinth members 9 existing in the light emitting range to each detector, and thus the dispersion at the 0 point level of the detection output of each detector caused by the difference of the number of edges can be prevented. Further, since the edge itself does not exist, the light from the light emitting device 12 is prevented from being irregularly reflected by the edge of the labyrinth member 90. With this arrangement, the 0 point of the detection output of a light scattered by smoke can be set to a low level.

Note, as shown in FIG. 1, the 0 point of the detection output of the light scattered by smoke can be set to a further low level by forming the labyrinth member 90 in such a manner that the surface thereof confronting with the light emitting device 12 is faced in the direction opposite to the light receiving device 13.

Figure 2:
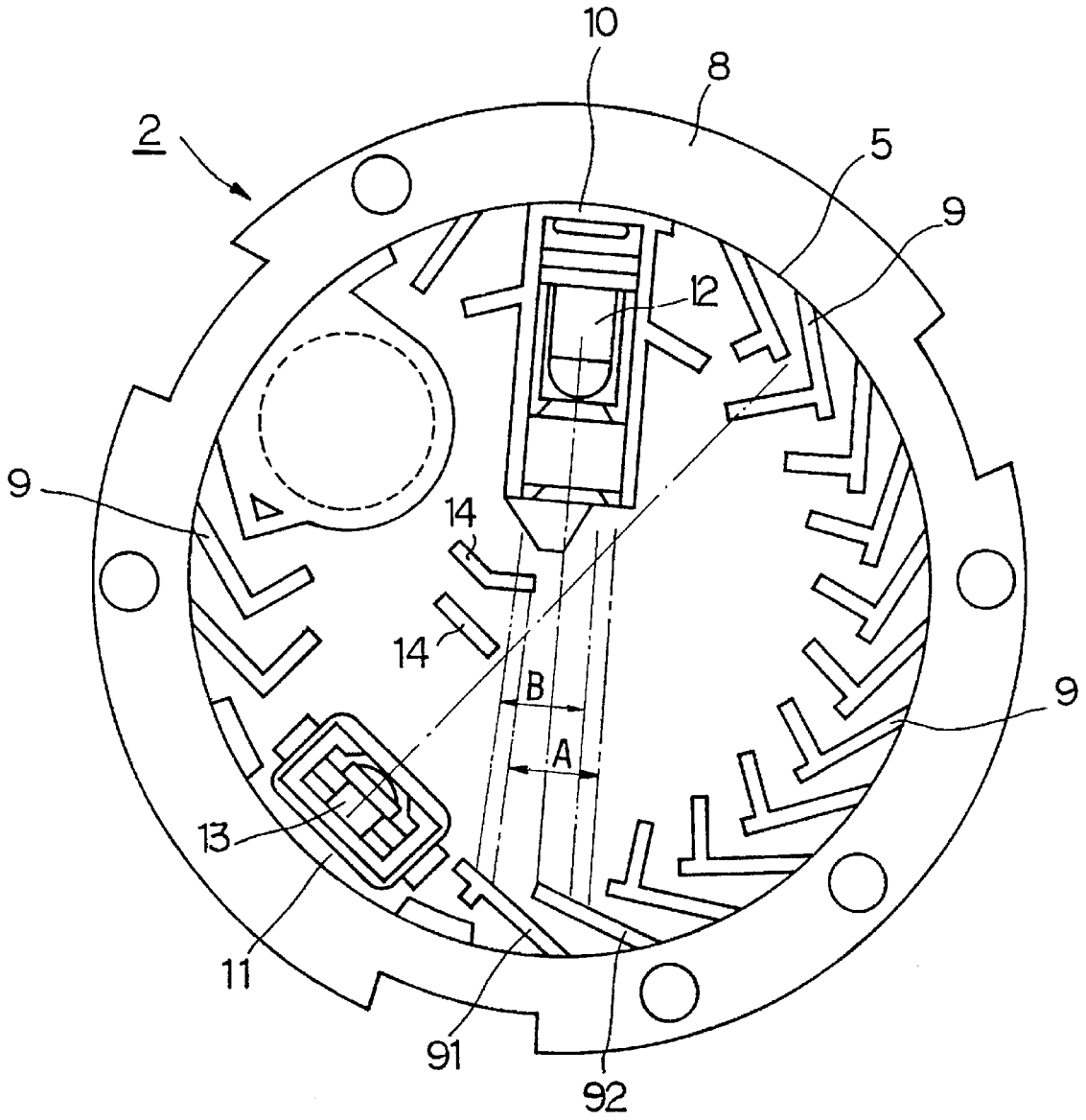
FIG. 2 is a plan view showing the arrangement of a second embodiment of the light scattering type smoke detector according to the present invention.

Next, a second embodiment of the light scattering type smoke detector according to the present invention will be described. FIG. 2 is a plan view showing the arrangement of the light scattering type smoke detector. This embodiment is arranged to obtain the same effect as the aforesaid one even when a single labyrinth member 90 cannot be formed in the light emitting ranges A and B for the convenience of design.

In this embodiment, two labyrinth members 91, 92 are formed in the light emitting ranges A and B. In this case, the labyrinth members 91, 92 are formed so that an edge exists without fail in the range of 5° (=10−5) where the range A is overlapped with the range B and any edge other than the above edge does not exist in the range of the angle including both ranges A and B.

As described above, in this embodiment, a light from the light emitting device 12 is irregularly reflected only by the edge of the labyrinth member 92. More specifically, only predetermined number of the edges always exist in the light emitting range and reflected light is produced only by these edges. Therefore, the dispersion at the 0 point level of the detection output to each detector can be prevented similarly as with the first embodiment. Note, in this case, since the edges exist by themselves in the light emitting range, the 0 point of the detection output cannot be set to a low level as compared with the example shown in FIG. 1. However, light from the light emitting device 12 is prevented from being irregularly reflected by edges other than the edge of the labyrinth member 92 and thus the dispersion at the 0 point level can be suppressed.

Figure 3:
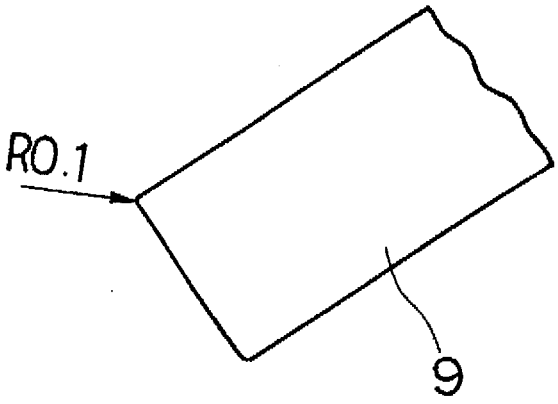
FIG. 3 is a diagram explaining the edge of a labyrinth member in a third embodiment of the light scattering type smoke detector according to the present invention.

Further, third and fourth embodiments of the light scattering type smoke detector according to the present invention will be described. FIG. 3 is a diagram explaining the edge of the labyrinth member in the third embodiment. In this embodiment, the edge of the labyrinth member 9 is formed to a predetermined radius of curvature or chamfered by a predetermined dimension.

As shown in FIG. 3, the edge of the labyrinth member 9 is formed by a curvature slightly exceeding the maximum value (r=0.08 mm) of the aforesaid dispersion, for example, by a curvature of about $1<r<0.2$ mm. When the edge is curved as described above, the direction in which light from the light emitting device 12 is reflected is dispersed as compared with the conventional labyrinth member 9 with a sharp edge and the reflected light is not directed to a particular direction. Therefore, the dispersion at the 0 point level of the detection output can be reduced.

The light irregularly reflected by the edge of the labyrinth member 9 is further irregularly reflected not only by other labyrinth members 9 but also by the edges and the like of recessed portions 10, 11, shade plate 14 and the like and introduced in the direction of the light receiving device 13. Therefore, in order to reduce the dispersion at the 0 point level of a detection output, the edges of all the labyrinth members 9, recessed portions 10, 11, shade plate 14 and the like are preferably formed to a curvature of about $0.1<r<0.2$ mm. Note, it is needless to say that the edge of the labyrinth member 9 with which the light emitting device 12 confronts is formed to a curvature of about 0.1<r<0.2 mm.

To form these members to the aforesaid curvature, the edge portion of a metal mold for making them must be formed in accordance with the curvature. Then, when the edge portion of the metal mold is formed to the predetermined curvature, the edges of the labyrinth members 9 and the like can be formed to an accurate shape regardless of the flow of plastics. Further, since the edge is curved, the edge of the labyrinth member is prevented from being chipped off when it is released from the metal mold. Therefore, the irregular reflection of a light from the light emitting device caused by these members is stabilized and thus the dispersion at the 0 point level of a detection output to each detector can be prevented. Further, when this degree of the curvature is employed, the light from the light emitting device 12 is prevented from being irregularly reflected by the edge of the labyrinth member 9. Consequently, the 0 point of the detection output of light scattered by smoke can be set to a low level.

Figure 4:
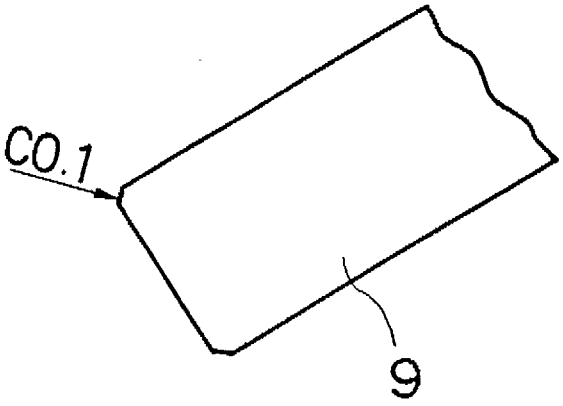
FIG. 4 is a diagram explaining the edge of a labyrinth member in a fourth embodiment of the light scattering type smoke detector according to the present invention.

FIG. 4 shows a fourth embodiment according to the present invention. That is, FIG. 4 shows the state of the edge of the labyrinth member of the embodiment.

The edge of the labyrinth member 9 of the above embodiment is formed to the predetermined curvature. As shown in FIG. 4, however, the edge of a labyrinth member 9 may be chamfered by a predetermined dimension C in place of the curving. Note, in this embodiment, the chamfering is performed by C0.1 which means the corner chamfering is 0.1 mm. In this case, however, light from a light emitting device 12 is slightly irregularly reflected by the edge of the labyrinth member 9. Therefore, although the 0 point of a detection output cannot be set to a low level as compared with the example shown in FIG. 3, since the edges of the labyrinth members 9 and the like have no dispersion to each detector, the dispersion at the 0 point level of the detection output can be prevented.

What is claimed is:

1. A light scattering type smoke detector enabling inflow of smoke from the outside as well as shutting off light from the outside, comprising; a plurality of labyrinth members having edge surfaces for forming a smoke detecting chamber centrally thereof; and a light emitting device and a light receiving device disposed in said smoke detecting chamber, with respective optical axes thereof intersecting in the smoke detecting chamber, said light emitting device being mounted in said smoke detecting chamber to produce a light projected area which defines a predetermined light emitting range which includes variations as modified due to dimensional errors in the mounting of said light emitting device during manufacturing and assembly of the smoke detector, said labyrinth member being formed and arranged in the smoke detector so that the number of edge surfaces of said labyrinth members in said light projected area is constant, whereby light from said light emitting device is substantially independent of said dimensional errors resulting from the manufacturing and assembly of said light emitting devices.

* * * * *